US005105750A

United States Patent [19]

Horie

[11] Patent Number: 5,105,750

[45] Date of Patent: Apr. 21, 1992

[54] PATTERN SEWING MACHINE PROVIDED WITH A CONTROL UNIT FOR THREAD DELIVERY

[75] Inventor: Fujio Horie, Yokohama, Japan

[73] Assignee: Brother Kogyo Kabushiki Kaisha, Japan

[21] Appl. No.: 755,132

[22] Filed: Sep. 5, 1991

[30] Foreign Application Priority Data

Sep. 7, 1990 [JP] Japan ..... 2-237821

[51] Int. Cl.[5] ..... D05B 63/00; D05B 65/00

[52] U.S. Cl. ..... 112/302; 112/121.11; 112/291; 112/300; 112/453

[58] Field of Search ..... 112/302, 300, 285, 121.11, 112/221, 291, 293, 294, 296, 453, 292, 298

[56] References Cited

U.S. PATENT DOCUMENTS 3,658,021 4/1972 Hedegaard et al. ..... 112/292
4,776,293 10/1988 Yoshida ..... 112/302
4,843,986 7/1989 Kozuka et al. ..... 112/302 X
4,967,679 11/1990 Hara et al. ..... 12/302 X
5,022,335 6/1991 Hanyu et al. ..... 112/453 X

FOREIGN PATENT DOCUMENTS 63-277089 11/1988 Japan ..... 112/302

*Primary Examiner*—Peter Nerbun
*Attorney, Agent, or Firm*—Oliff & Berridge

[57] ABSTRACT

A pattern sewing machine provided with a thread trimmer and a thread delivery unit. After a series of patterns is completed and the thread trimmer trims thread, the thread delivery unit is prohibited from delivering thread until the next sewing operation starts to form another pattern. When the patterns are distant from each other, a needle bar is disconnected and fabric is fed a distance in a non sewing operation. No excess thread is delivered corresponding to the feeding distance of the fabric, thus preventing thread from being wasted. Furthermore, an operator can avoid the cutting of excess thread with scissors. The sewing efficiency is thus enhanced. In the pattern sewing machine the crossover thread connecting the patterns is automatically cut regardless of the distance between the patterns.

14 Claims, 7 Drawing Sheets

PATTERN SEWING MACHINE PROVIDED WITH A CONTROL UNIT FOR THREAD DELIVERY

BACKGROUND OF THE INVENTION

This invention relates to a pattern sewing machine provided with a thread trimmer and a thread delivery unit in which after a sewing operation, the thread trimmer trims thread and the thread delivery unit is prohibited from delivering thread till another sewing operation starts. Thread is thus prevented from being wasted in a non sewing operation, thereby eliminating the necessity of trimming unnecessarily delivered thread.

In a known pattern sewing machine, after the sewing operation, needle thread is trimmed. During the sewing operation stitches are made with needle thread and bobbin thread on fabric. In the pattern sewing machine the tension release mechanism of a tension regulator releases needle thread from the tension regulator. In the thread trimmer, a movable knife trims the released needle thread in cooperation with a fixed knife. When the needle thread is trimmed, the needle thread having the length corresponding to the quantity of motion of the movable knife is delivered against the tension applied by a pre-tension assembly. The pre-tension assembly is positioned closer to a thread supply source than to the tension regulator. Therefore, after the needle thread is trimmed, remainder needle thread is delivered from the eye in the needle. The amount of remainder needle thread depends on the tension applied by the pre-tension assembly. When the size and material of the needle thread vary, the frictional resistance between the needle thread and the pre-tension assembly varies, thereby altering the amount of remainder needle thread. If remainder needle thread is too long, the excess needle thread is entangled with the bobbin thread when the next sewing operation starts. If remainder needle thread is too short, the remainder needle thread goes out of the eye in the needle when the next sewing operation starts.

To solve the problem caused by too long or short remainder needle thread, Japanese Laid-open Patent Application No. 63-277089 proposes a pattern sewing machine comprising a thread delivery unit and a thread trimmer. The thread delivery unit delivers a predetermined amount of needle thread toward a needle for forming stitches on fabric. After forming stitches on the fabric, the thread trimmer trims needle thread, and the thread delivery units delivers the predetermined amount of remainder needle thread. Consequently, remainder needle thread has a constant length.

A known pattern sewing machine forms various patterns on fabric corresponding to various pattern data pre-stored in a memory. By mounting the thread trimmer and a required control unit onto the pattern sewing machine, crossover thread is automatically cut. As shown in FIGS. 7A and 7B, when characters A and B are formed on fabric, the crossover thread connects the end of the character A and the beginning of the character B. If in the pattern sewing machine the crossover thread is automatically cut, an operator need not cut unnecessary crossover thread with scissors after a series of patterns are formed, thereby contributing to sewing efficiency. If the thread delivery unit is added to the pattern sewing machine, thread tension can be regulated automatically. The pattern sewing machine thus provided with the thread trimmer and the thread delivery unit still has a problem to solve. Specifically, in the pattern sewing machine, after the crossover thread is automatically cut, a needle lowers into the fabric to form the next pattern, followed by excess needle thread delivered by the thread delivery unit. The excess needle thread has the length corresponding to the distance between the previously formed pattern and the next pattern to form. If the distance between the patterns is short, the crossover thread between the patterns is also short. After the crossover thread is cut, the thread delivery unit delivers short but excess needle thread between the patterns. On the other hand, when the distance between the patterns is large, after forming the pattern, a needle bar is disconnected until the next pattern formation starts. The excess needle thread delivered by the thread delivery unit between the patterns results in a large amount through the entire sewing operation. After the crossover thread is cut, the excess needle thread is unnecessarily delivered. The operator is involved in the time-consuming and troublesome cutting of the excess needle thread with scissors.

SUMMARY OF THE INVENTION

An object of this invention is to provide a pattern sewing machine comprising a thread trimmer and a thread delivery unit in which after the sewing operation, the thread trimmer trims thread and the thread delivery unit is controlled to prohibit the delivery of thread till the next sewing operation starts. Thread is thus prevented from being wasted. The trimming of excess thread is saved.

To attain this or other object, the present invention provides a pattern sewing machine comprising a stitch forming means, a thread delivery means, a thread trimming means, a thread trimming detection means, a stitch formation detection means and a delivery control means. The stitch forming means forms stitches on a fabric with a needle and a bobbin. The thread delivery means delivers a predetermined amount of a thread for forming the stitches on the fabric. The thread trimming means includes a movable knife and a fixed knife for trimming a needle thread and a bobbin thread between the movable knife and the fixed knife after the stitch forming means forms the stitches on the fabric. The thread trimming detection means detects that the thread trimming means trims the needle thread and the bobbin thread. The stitch formation detection means detects that the stitch forming means forms the stitches on the fabric. The delivery control means prevents the thread delivery means from delivering the needle thread after the thread trimming detection means detects that the thread trimming means has cut the needle thread and the bobbin thread until the stitch formation detection means detects that the stitch forming means restarts the formation of stitches on the fabric.

DETAILED DESCRIPTION OF THE PREFERRED EMBODIMENT

Figure 2:
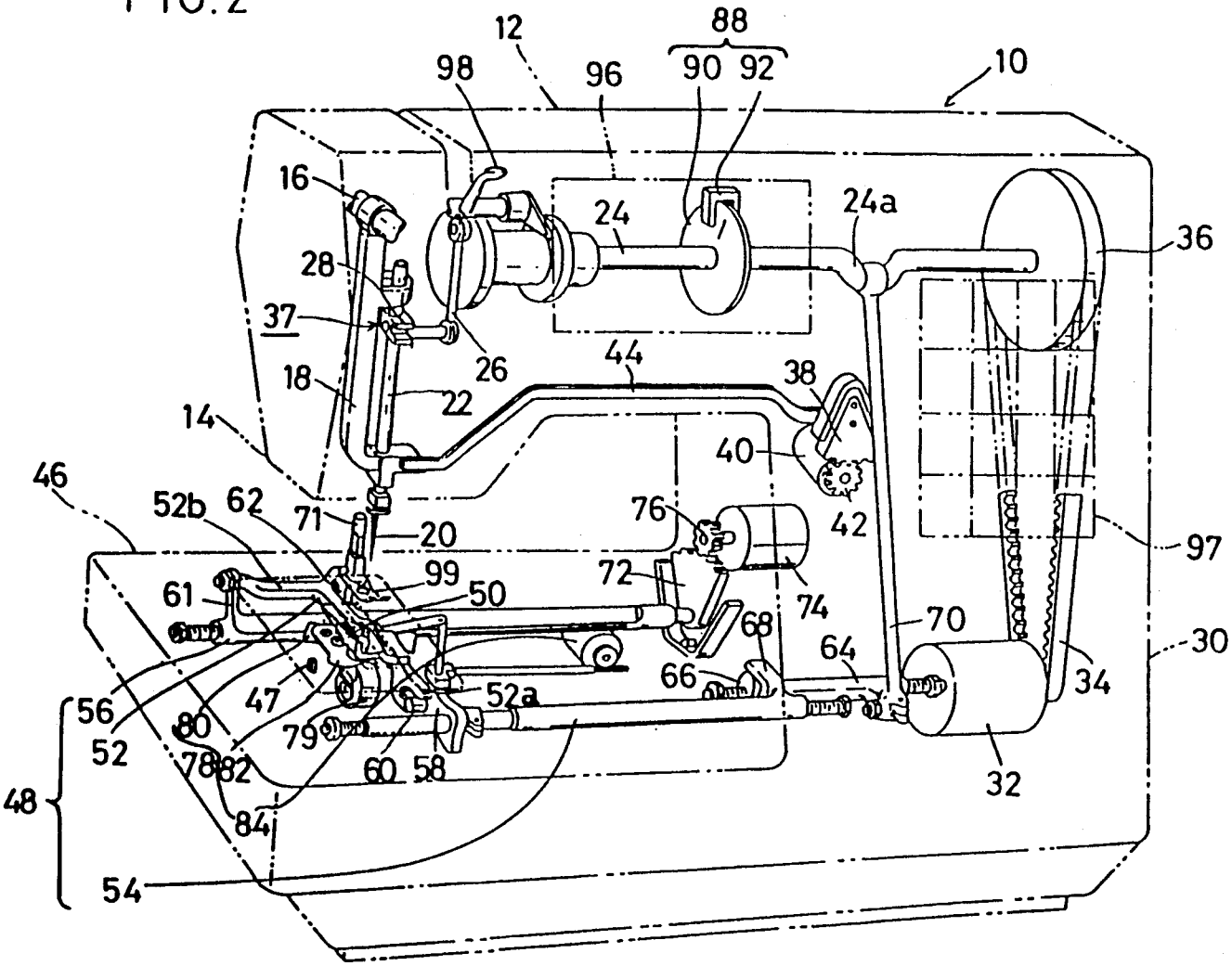
FIG. 2 is a schematic view of the pattern sewing machine.

As shown in FIG. 2, in an electronically controlled pattern sewing machine 10, a support 18 hangs from a pin 16 in a head 14 at the left end of an arm 12, as the figure is viewed, such that the support 18 can rotate by a predetermined angle. The support 18 supports a needle bar 22 carrying a needle 20 at its lower end, such that the needle bar 22 is vertically movable. In the arm 12, an arm shaft 24 is horizontally provided. A connecting rod 26 is connected from the arm shaft 24 via a needle bar connecting stud 28 to the needle bar 22. In a bed leg 30 a sewing machine motor 32 is provided. The drive power of the sewing machine motor 32 is transmitted through a belt 34, a pulley 36 and the arm shaft 24 to the connecting rod 26, thereby moving the arm shaft 24 rotatably and the needle bar 22 vertically.

NEEDLE BAR DISCONNECTING AND STITCH FORMATION DETECTING

Figure 3:
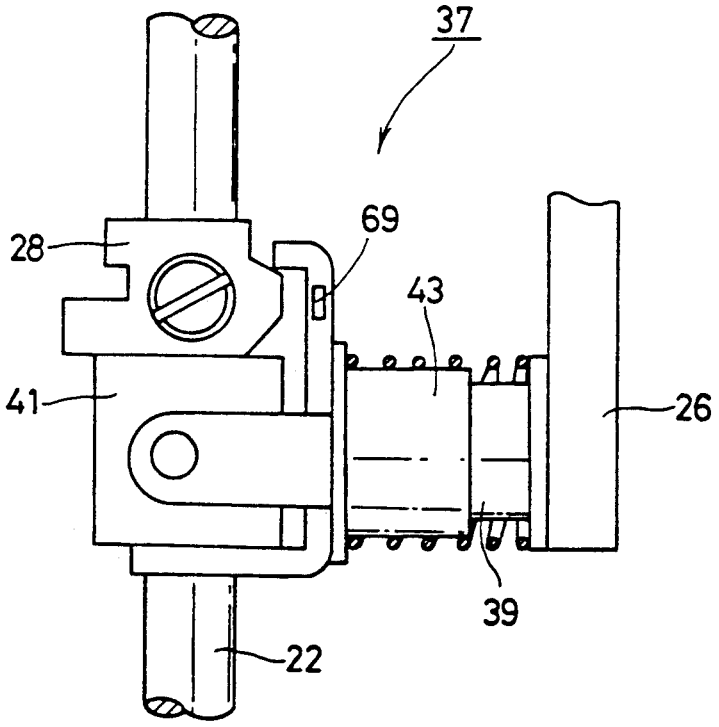
FIG. 3 is a view of a needle bar disconnecting mechanism in the pattern sewing machine.

In a disconnecting mechanism 37 shown in FIG. 3 the needle bar 22 is selectively disconnected from the connecting rod 26. The disconnecting mechanism 37 includes the needle bar connecting stud 28 attached to the needle bar 22 and a slide 41 slidably mounted to the needle bar 22. The slide 41 is connected via a horizontal shaft 39 to the connecting rod 26, and a clutch 43 is interposed between the slide 41 and the horizontal shaft 39. When a not-shown drive unit is driven, the clutch 43 disconnects the slide 41 from the needle bar connecting stud 28. The needle bar 22 is disconnected from the connecting rod 26 and is maintained in an elevated position. For example, when the next pattern to form is distant from the previous formed pattern, the needle bar 22 is thus disconnected in the elevated position, and only fabric can be fed during a non sewing operation. As shown in FIG. 3, a stitch formation detector 69 is adjacent to the clutch 43. The stitch formation detector 69 is comprised of a reflective photo sensor, and can detect that the clutch 43 connects the slide 41 and the needle bar connecting stud 28. Specifically, when the stitch formation detector 69 optically detects the clutch 43, the slide 41 is connected to the needle bar connecting stud 28, and the drive power is transmitted from the connecting rod 26 to the needle bar 22. The stitch formation detector 69 detects that stitches are being formed on fabric just by detecting the existence of the clutch 43. On the other hand, when the stitch formation detector 69 detects no existence of the clutch 43, the slide 41 is disconnected from the needle bar connecting stud 28 and the needle bar 22 is disconnected. Therefore, the stitch formation detector 69 detects that stitches are not being formed on fabric. It is determined by the command from a CPU 94 described later and shown in FIG. 1 whether the needle bar 22 is disconnected or not during the operation of the pattern sewing machine 10.

NEEDLE BAR ROCKING

In the bed leg 30, a sector gear 38 rotatably meshes with a pinion 42 of a stepping motor 40 for rocking the needle bar 22. As shwon in FIG. 2, the sector gear 38 is connected through a connector 44 to the support 18. By rotating the stepping motor 40 forward and backwards, the sector gear 38 rotates by a bounded angle. The rotation of the sector gear 38 is transmitted via the connector 44, thereby rocking the support 18 and the needle bar 22.

FABRIC FEEDING

An arm bed 46 houses a feeding mechanism 48. The feeding mechanism 48 operates almost synchronously with the needle bar 22. A feed dog 50 is connected to the feeding mechanism 48, for feeding not-shown fabric vertically and back and forth. The feeding mechanism 48 includes a feed bar assembly 52 for supporting the feed dog 50, a feed lifting rock shaft 54 for moving the feed bar assembly 52 vertically, and a feed rock shaft 56 for moving the feed bar assembly 52 back and forth. A fork 52*a* and a T portion 52*b* are formed at the front and back end of the feed bar assembly 52, respectively. The feed lifting rock shaft 54 is pivotably supported at the side of the operator in the arm bed 46. A feed lifting crank 58 perpendicularly extends from the feed lifting rock shaft 54 and connects via a stud 60 to the fork 52*a*. The feed rock shaft 56 is supported in the back of the arm bed 46 such that the feed rock shaft 56 can rock around an axis. Rods 61 and 62 extend perpendicularly from the feed rock shaft 56. The T portion 52*b* of the feed bar assembly 52 is pivotably attached to the rods 61 and 62.

A rocking shaft 64 is rotatably provided at the back of the feed lifting rock shaft 54. A cam 66 is secured to the rocking shaft 64 and is engaged with a forked rod 68 extending perpendicularly from the feed lifting rock shaft 54. The rocking shaft 64 is connected via a rod 70 to a connecting rod 24*a* formed onto the arm shaft 24. When the sewing machine motor 32 is driven, the arm shaft 24 rotates, thereby moving the needle bar 22 vertically. The drive power of the sewing machine motor 32 is transmitted via the arm shaft 24 to the rod 70, thereby rotating the rocking shaft 64. The drive power is transmitted from the rocking shaft 64 through the cam 66, the forked rod 68, the feed lifting rock shaft 54 and the feed bar assembly 52, thereby moving the feed dog 50 vertically.

A sector gear 72 is secured to the right end of the feed rock shaft 56 as the figure is viewed. The sector gear 72 meshes with a pinion 76 of a stepping motor 74 in the bed leg 30. When the stepping motor 74 is driven synchronously with the vertical movement of the feed dog 50, the feed dog 50 moves back and forth in the raised or lowered position of the feed dog 50.

THREAD TRIMMING AND THREAD TRIMMING DETECTING

In the arm bed 46 a thread trimmer 78 is provided in the area where the needle 20 lowers. The thread trimmer 78 trims needle thread and bobbin thread according to a predetermined command. The thread trimmer 78 is composed of a fixed knife 80 provided in the vicinity of a rotary hook assembly 79, a movable knife 82 for slidably engaging the fixed knife 80, and a trimmer stepping motor 84 for driving the movable knife 82. In the specified range of the rotary phase of the arm shaft 24, the movable knife 82 cooperates with the fixed knife 80 and trims the needle thread and the bobbin thread. In the rotary area of the movable knife 82 a thread trimming detector 47 comprised of a reflective photo sensor is provided for detecting that the thread trimmer 78 trims the needle thread and the bobbin thread. A command for thread trimming can be included in the pattern data stored in a ROM 29 described later and shown in FIG.

1. Consequently, by reading the command for thread trimming from the ROM 29, the trimming of the needle thread and the bobbin thread can be detected.

THREAD DELIVERY

Figure 4:
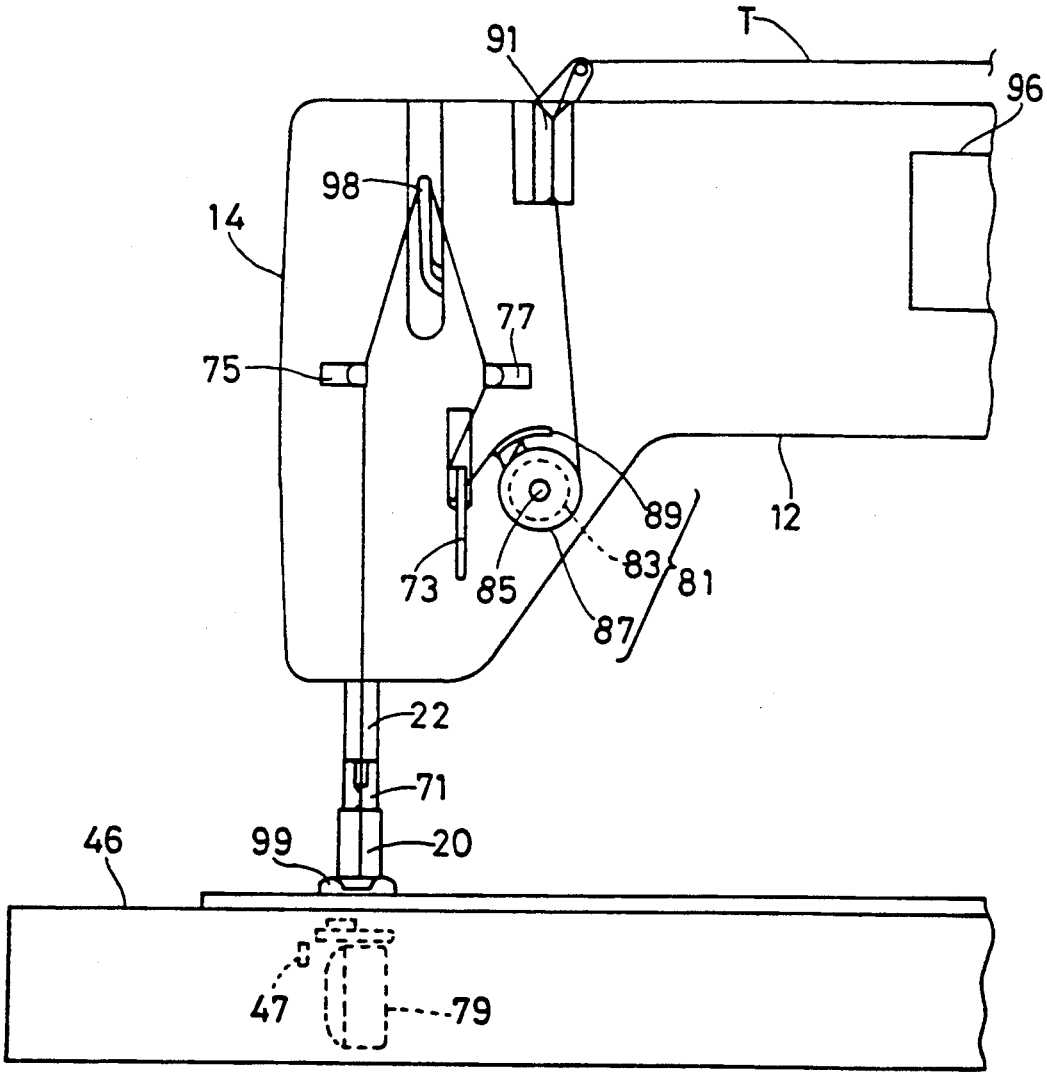
FIG. 4 is an explanatory view of a head provided with a thread delivery unit in the pattern sewing machine.

As shown in FIG. 4 a needle thread take-up 98 is provided at the side of the operator on the head 14 of the pattern sewing machine 10, such that the needle thread take-up 98 is vertically movable. Below the needle thread take-up 98 provided are a pair of left and right thread guides 75 and 77 as the figure is viewed. Below the right thread guide 77 provided is a movable thread guide 73. The movable thread guide 73 rises and lowers together with a presser bar 71. A thread delivery unit 81 is also provided at the side of the operator on the head 14, for delivering a predetermined amount of needle thread when the stitches are formed on fabric. The thread delivery unit 81 includes a servo motor 83 housed in the head 14, a winder 87 mounted onto the output shaft 85 of the servo motor 83 in the head 14, and a thread take-up spring 89 positioned adjacent to the winder 87. The thread delivery unit 81 delivers needle thread T toward the needle 20. The needle thread T supplied from a not-shown thread supply source is passed from a tension disc 91 through the winder 87, the thread take-up spring 89, the movable thread guide 73, the right thread guide 77, the needle thread take-up 98 and the left thread guide 75 into the eye in the needle 20.

THE DETECTING OF THE CURRENT POSITION OF THE NEEDLE BAR

As shown in FIG. 2, a phase detector 88 is provided onto the arm shaft 24, for detecting the rotary phase of the arm shaft 24 and the current position of the needle bar 22 vertically moving. The phase detector 88 is comprised of a disc 90 having a radial slit and a photo interrupter 92 for holding therein the disc 90. When the rotary phase of the disc 90 and the arm shaft 24 is about 360 degrees, the photo interrupter 92 detects that the light beam passes through the slit in the disc 90, and sends a timing signal to the CPU 94 shown in FIG. 1. The timing signal corresponds to the current position of the needle bar 22.

A liquid crystal display 96 is provided at the side of the operator on the arm 12. The liquid crystal display 96 shows the pattern selected by the operator. A pattern input unit 97 composing a key panel is provided onto the bed leg 30. The operator can register the selected pattern with the pattern input unit 97. The drive mechanism for the needle thread take-up 98 and the mechanism for connecting the presser bar 71 to a presser foot assembly 99 are well known for those skilled in the art and are omitted from the drawing and the description for the sake of simplicity.

THE CONTROL SYSTEM FOR THE SEWING MACHINE

The control system of the pattern sewing machine 10 will now be explained referring to the block diagram in FIG. 1. The pattern input unit 97, the stitch formation detector 69, the phase detector 88 and the thread trimming detector 47 are connected directly to an I/O interface 11 in a control circuit C. The sewing machine motor 32, the stepping motor 74, the stepping motor 40, the servo motor 83 and the liquid crystal display 96 are connected via drive circuit 15, 19, 17, 45 and 21, respectively, to the I/O interface 11.

The trimmer stepping motor 84 is connected via a drive circuit 23 and an AND circuit 25 to the I/O interface 11. The AND circuit 25 sends a drive signal to the drive circuit 23 in response to AND conditions: the thread trimming signal sent from a memory 35 described later and the signal indicative of the lowering of the needle bar 22 sent from the phase detector 88. The memory 35 stores the portion of the crossover thread to cut. When the drive circuit 23 receives the thread trimming signal and the signal indicative of the lowering of the needle bar 22, the trimmer stepping motor 84 is driven. The needle thread and the bobbin thread are cut between the movable knife 82 and the fixed knife 80 of the thread trimmer 78.

Other known elements for operating the pattern sewing machine 10 are also connected to the I/O interface 11: a start/stop switch for selectively starting or stopping the operation of the pattern sewing machine 10, a speed detector for detecting the rotary speed of the arm shaft 24, a volume for adjusting the rocking amount of the needle bar 22, a volume for adjusting the feed amount of fabric, a clock pulse generator for synchronizing the operation of movable components, and other known elements. These known elements are omitted from the drawing and the description for the sake of simplicity.

The CPU 94, the ROM 29 and a RAM 31 are connected via a bus 27 to the I/O interface 11. The ROM 29 stores the pattern data involving the needle location data for sewing various characters, symbols and other patterns. The needle location data includes the feed amount data and the needle rock data. The ROM 29 also stores the control program for reading the selected stitch pattern data and controlling the stepping motor 74 based on the feed amount data in response to the feed start signal. The ROM 29 further stores the control program for controlling the sewing machine motor 32 and the control program for determining the feed start timing based on the feed amount data and the speed signal. The RAM 31 includes various memory unit for temporarily storing the results of the computation by the CPU 94.

The I/O interface 11 is connected via the bus 27 to a thread delivery control unit 65 for causing the thread delivery unit 81 not to deliver the thread. After the thread trimming detector 47 detects that the thread trimmer 78 has trimmed thread, the thread delivery control unit 65 keeps the thread delivery unit 81 inoperative until the next stitch formation is detected. Therefore, no thread is delivered after the thread is trimmed until the next sewing operation starts.

The I/O interface 11 is connected via the bus 27 to a thread trimming designation unit 33 and the memory 35. The thread trimming designation unit 33 specifies the cut portion of the crossover thread between the previous and next patterns, before the next pattern is formed according to the stitch pattern data stored in the CPU 94. The thread trimming designation unit 33 reads the thread trimming code included in the stitch pattern data from the CPU 94 and determines which stitch corresponds to the end of a specified pattern and to the cut portion. The memory 35 stores the cut portion of the crossover thread specified by the thread trimming designation unit 33. The cut portion of the crossover thread could be temporarily stored in the RAM 31, if the RAM 31 has a room.

OPERATION

Figure 7A:
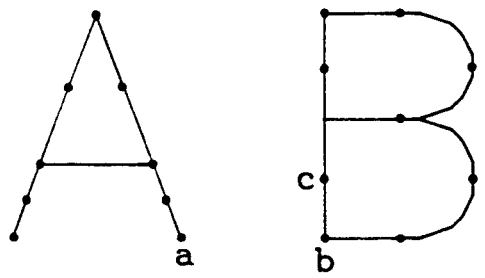
FIGS. 7A and 7B is a schematic view of character patterns formed by the pattern sewing machine.
Figure 7B:
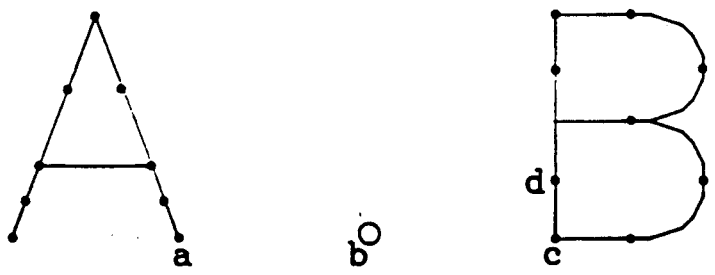

As shown in FIG. 4, the needle thread T is first passed successively through the tension disc 91, the winder 87, the thread take-up spring 89, the movable thread guide 73, the right thread guide 77, the needle thread take-up 98 and the left thread guide 75 into the eye in the needle 20. The pattern to form is input using the pattern input unit 97, and the input and selected pattern is shown on the liquid crystal display 96. Subsequently, a not shown start/stop switch is pressed, thus sending the start signal to the CPU 94. Acording to the control program stored in the ROM 29 the sewing machine motor 32 is driven via the drive circuit 15, thus rotating the arm shaft 24. According to the fee amount data for each sewing operation stored in the ROM 29, the stepping motor 74 is driven via the drive circuit 19, thus moving the feed dog 50 vertically and back and forth. According to the needle rock date for each sewing operation stored in the ROM 29, the stepping motor 40 is driven via the drive circuit 17, thus oscillating the needle bar 22 in the direction perpendicular to the cloth feeding direction. Such controlled vertical and horizontal movement of the needle bar 22 and the needle 20 as well as the vertical and reciprocating movement of the feed dog 50 form stitches successively on not shown fabric according to the stitch pattern data. While stitches are formed on the fabric, the servo motor 83 of the thread delivery unit 81 is rotated, thus delivering a predetermined amount of needle thread toward the eye in the needle 20. When the stitches are formed into patterns, as shown in FIG. 7A and 7B, the crossove thread connects the end of the pattern and the beginning of the next pattern. In this embodiment since the thread trimming designation unit 33 specifies the cut portion of the crossover thread and the memory 35 stores the cut portion of the crossover thread, the crossover thread can be cut automatically.

Specifically, as shown in FIGS. 7A and 7B, when the characters A and B are formed, the operator manually registers beforehand into the thread trimming designation unit 33 that the portion between the end of the character A and the beginning of the character B is cut. The cut portion is stored in the memory 35.

Figure 1:
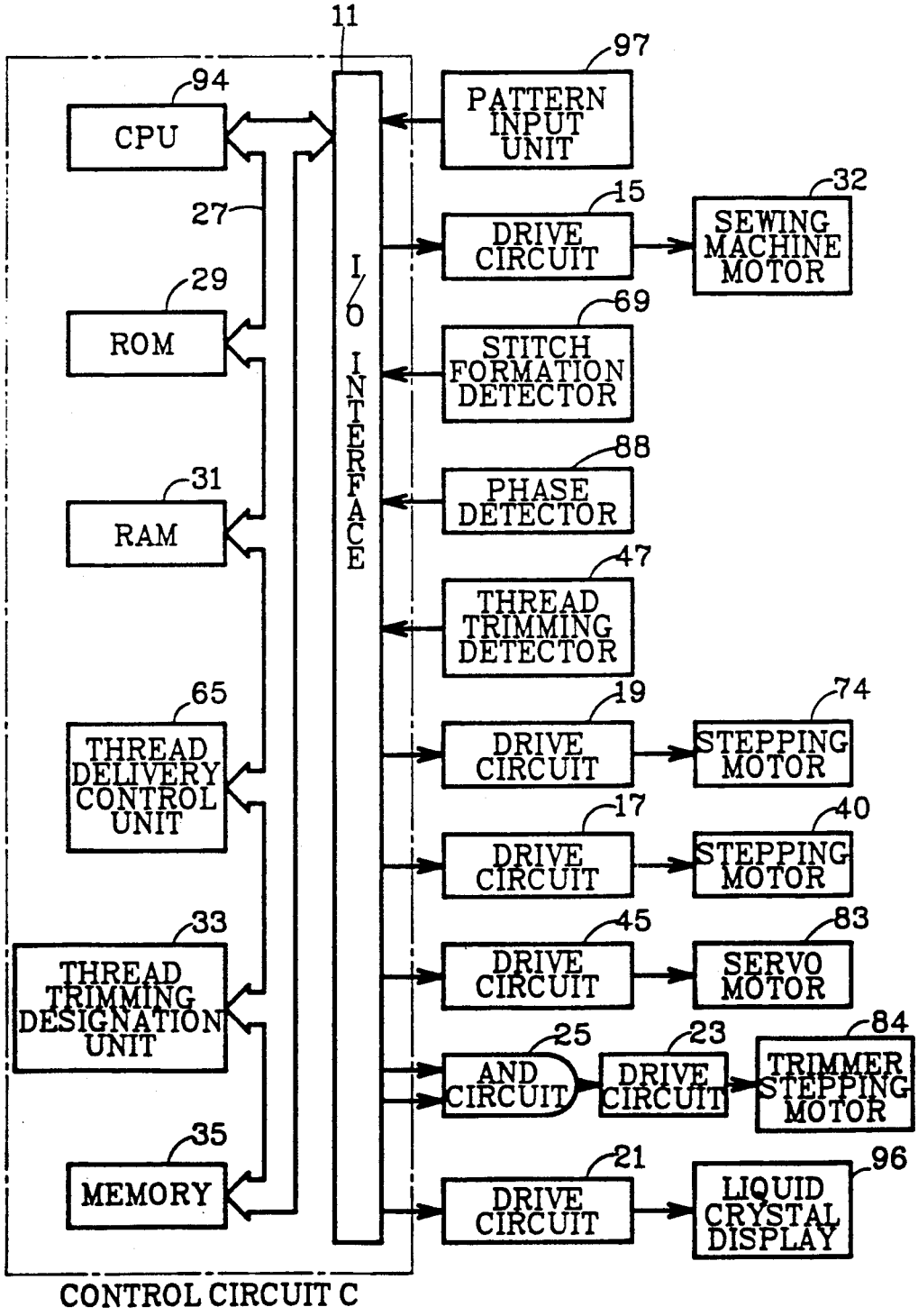
FIG. 1 is a block diagram of a control circuit for a pattern sewing machine embodying this invention.

In operation, when the needle 20 lowers into the end "a" of the character A, as shown in FIG. 1, the memory 35 sends a thread trimming signal to one terminal of the AND circuit 25 connected to the drive circuit 23. The AND circuit 25 sends a drive signal to the drive circuit 23 on the condition that the AND circuit 25 receives the thread trimming signal from the memory 35 and the timing signal from the phase detector 88. The timing signal sent from the phase detector 88 indicates that the needle bar 22 is in its lowered position. The drive circuit 23 drives the trimmer stepping motor 84, thus operating the movable knife 82 of the thread trimmer 78. The needle thread as well as the bobbin thread are thus cut at the end "a".

In the same way, when the needle lowers into the beginning "b" of the character B, the memory 35 sends the thread trimming signal to one terminal of the AND circuit 25. The AND circuit 25 sends the drive signal to the drive circuit 23 on the condition that the AND circuit 25 recveives the thread trimming signal from the memory 35 and the timing signal from the phase detector 88. The drive circuit 23 drives the trimmer stepping motor 84 to operate thread trimmer 78. The needle thread as well as the bobbin thread are thus cut at the beginning "b".

As aforementioned, the operator manually sets the cut portion into the thread trimming designation unit 33. The cut portion can be automatically determined according to input patterns. By including a trimming flag into the pattern data beforehand as shown in Table 1, necessary trimming can be carried out automatically.

TABLE 1

| PATTERN | TRIMMING FLAG |
|---|---|
| UNDERLINED ALPHABETICAL WORDS | 0 (NO TRIMMING) |
| SPACING | 1 (TRIMMING) |
| JAPANESE HIRAGANA/ KATAKANA CHARACTERS (REQUIRING NO UNDERLINING) | 1 (TRIMMING) |

For example, the following pattern comprises the combination of two underlined alphabetical words and the spacing interposed between the words. In this combined pattern, crossover thread composes underline.

B_R_O_T_H_E_R_S_E_W_I_N_G

When the operator registers the pattern data of the above pattern with the pattern input unit 97, the trimming flag is included in the pattern data. Where the trimming flag is one, crossover thread is automatically trimmed. Where the trimming flag is zero, crossover thread is not trimmed.

When the thread trimmer 78 cuts the crossover thread, the thread trimming detector 47 detects that the crossover thread is cut, and sends a signal through the I/O interface 11 and the bus 27 into the CPU 94. After the crossove thread is cut, the feed dog 50 feeds the fabric to form the next pattern. If the next pattern is distant from the previously formed pattern, the CPU 94 sends a command for disconnecting the needle bar 22. Specifically, a not shown drive unit actuates the clutch 43, and the slide 41 is disconnected from the needle bar connecting stud 28. Subsequently, the needle bar 22 is disconnected from the connecting rod 26 and stopped at its elevated position. The stitch formation detector 69 detects no existence of the clutch 43 and sends to the CPU 94 a signal indicative of no stitches being formed on the fabric.

On the condition that the thread trimming detector 47 detects that the crossover thread has been cut and the stitch formation detector 69 detects that no stitches are formed, as shown in FIG. 1, the thread delivery control unit 65 keeps the thread delivery unit 81 inoperative. Under the control of the thread delivery control unit 65, no thread is delivered until the next stitch formation starts. When the next pattern to form is distant from the previously formed pattern, the needle bar 22 is disconnected and the fabric is fed a desired distance. While the fabric is being fed, the thread delivery unit 81 delivers no thread. Consequently, no thread is wasted. Furthermore, the operator need not do the time consuming and intricate cutting of excessively delivered thread with scissors. After the fabric is fed the predetermined distance, the CPU 94 sends a command for actuating the clutch 43. The slide 41 is connected to the needle bar connecting stud 28. The needle bar 22 lowers to the fabric, thus resuming the stitch formation. The stitch formation detector 69 for monitoring the clutch 43 detects that the needle bar 22 lowers and that the stitches are formed on the fabric, and sends to the CPU 94 a signal indicative of such detection. The thread delivery unit 81 is released from the control of the thread delivery control unit 65 and delivers a desired amount of thread toward the needle 20.

A series of operation from the time a thread trimming command is sent until the thread delivery unit 81 resumes the delivery of thread will now be explained referring to the flowchart in FIG. 5 and the timing charts in FIGS. 6A and 6B.

Figure 6A:
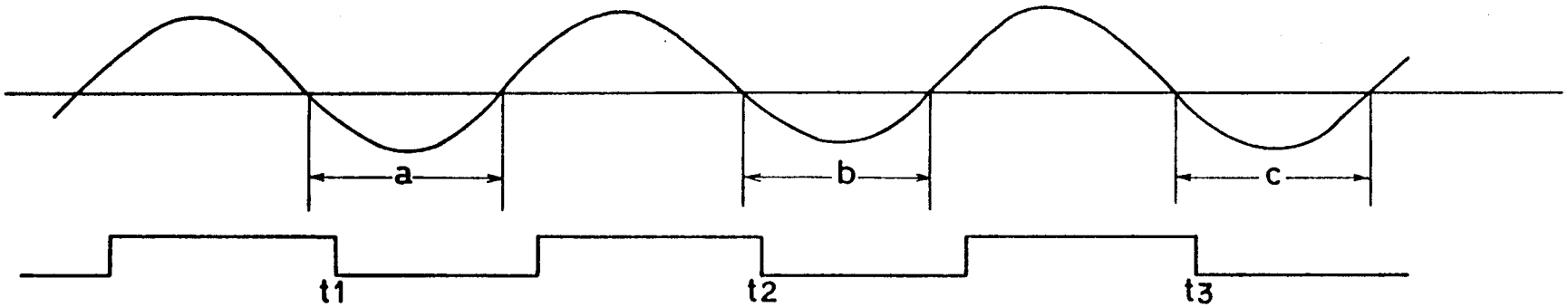
FIGS. 6A and 6B are timing charts showing the relation between the trail of a needle bar and timing signal.

(1) When, as shown in the timing chart of FIG. 6A, the needle bar 22 is connected between the end "a" of the character A and the beginning "b" of the character B in FIG. 7A, the following process steps are carried out.

Figure 5:
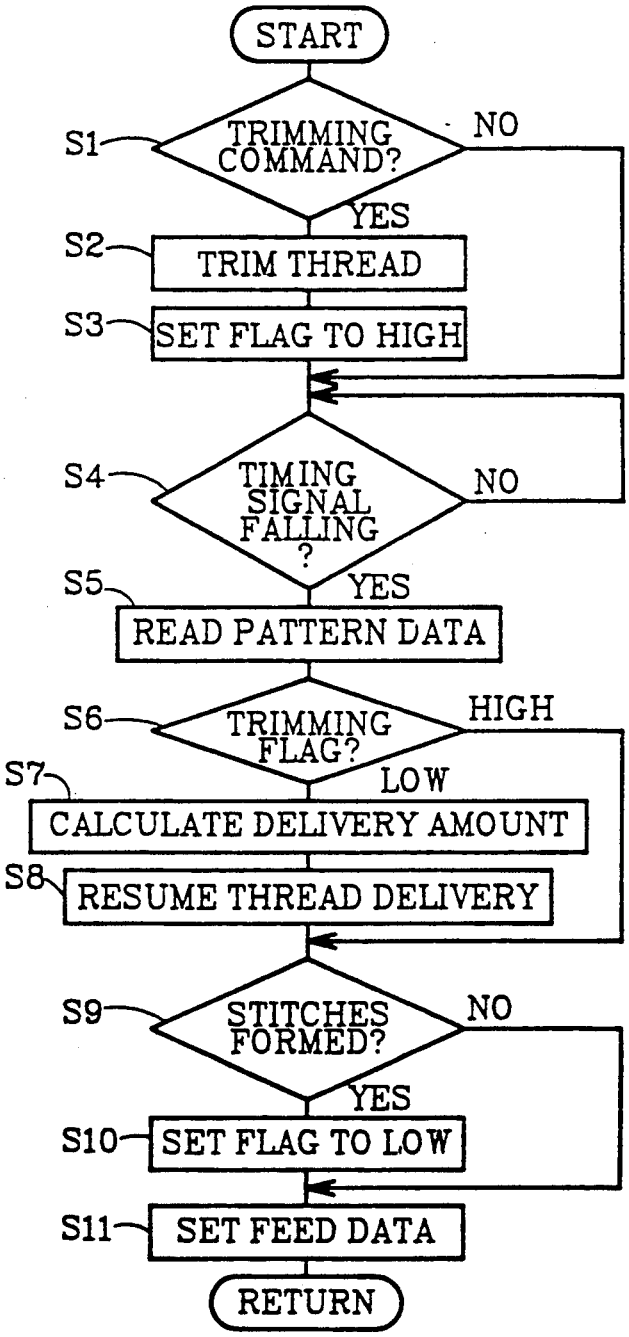
FIG. 5 is a flowchart of sewing process steps.

(1)-IAfter thread trimming, process steps corresponding to the timing signal between time t1 to t2 shown in FIG. 6A:

When thread delivery subroutine starts, as shown in FIG. 5, it is first determined at step S1 whether a thread trimming command is sent or not. Since the character A shown in FIG. 7A has been formed, it is determined at step S1 that thread trimming command is sent, and at step S2 thread is trimmed. Specifically, when the needle 20 lowers into the fabric, the crossover thread between the characters A and B is cut at the end "a" of the character A corresponding to the left end of the crossover thread as FIG. 7a is viewed. The method and apparatus for cutting the crossover thread is disclosed in the U.S. Pat. No. 3,658,021 and is omitted from the description herein. Subsequently, at step S3 the thread trimming detector 47 turns on and the trimming flag is set to high, thus indicating that the crossover thread has been cut. It is determined at step S4 whether the timing signal of the needle bar 22 sent from the phase detector 88 falls or not. This process step loops until it is determined at step S4 that the timing signal of the needle bar 22 falls. The determination at step S4 becomes affirmative at time t1 in FIG. 6A, and at step S5 the pattern data including the fabric feed data and the needle bar disconnecting data is read.

It is then determined at step S6 that the trimming flag is high. Process steps jump steps S7 and S8 for S9. The thread delivery control unit 65 keeps the thread delivery unit 81 inoperative, thus stopping the thread delivery between the end a of the character A and the beginning b of the character B in FIG. 7A. If the pattern data read at step S5 does not include the needle bar disconnecting data at the beginning b of the character B in FIG. 7A, at step S9 the stitch formation detector 69 detects that stitches are being formed. Subsequently, at step S10 the trimming flag is set to low. At step S11 the fabric feed data of the feeding mechanism 48 is set. The feeding mechanism 48 includes the feed dog 50, the feed bar assembly 52, the feed rock shaft 56 and the rod 70. The process step then returns and the thread delivery subroutine starts. Since the character stitch is not completed, it is determined at step S1 that no trimming command is sent. The process steps jumps steps S2 and S3 for S4. It is determined at step S4 whether the timing signal of the needle bar 22 sent from the phase detector 88 falls or not. This process step loops until it is determined at step S4 that the timing signal of the needle bar 22 falls. The determination at step S4 becomes affirmative at time t2 in FIG. 6A.

(1)-2Processs steps correponding to the timing signal between time t2 to t3 shown in FIG. 6A:

Subsequently, at step S5 the pattern data is read. This pattern data includes the fabric feed data, the needle bar data and the needle bar disconnecting data between the beginning b of the character B and a stitch point c.

Subsequently, it is determined at step S6 that the trimming flag is low, and at step S7 the thread delivery amount between the beginning B and the stitch point c is calculated, thus resuming the thread delivery by the thread delivery unit 81 at step S8. If the pattern data read at step S5 does not include the needle bar disconnecting data at the stitch point c of the character B in FIG. 7A, at step S9 the stitch formation detector 69 detects that stitches are being formed. Subsequently at step S10 the trimming flag is set to low. At step S11 the fabric feed data of the feeding mechanism 48 is set. The feeding mechanism 48 includes the feed dog 50, the feed bar asssembly 52, the feed rock shaft 56 and the rod 70. The process step then returns and the thread delivery subroutine is repeated until the character B in FIG. 7A is completed.

Figure 6B:
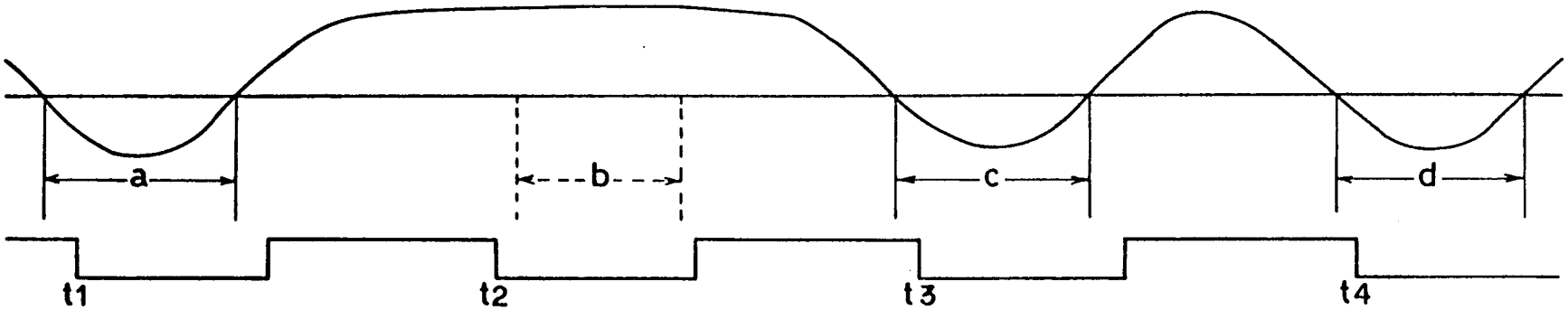

(2) When, as shown in the timing chart of FIG. 6B, the needle bar 22 is disconnected between the end "a" of the character A and the beginning "c" of the character B in FIG. 7B, the process steps are similar to those explained in the item (1). The chart is different from the item (1), since the needle bar 22 is disconnected at the point b. The pattern data between the end "a" and the point "b" includes the needle bar disconnecting data. Therefore, if it is determined at step S9 that no stitches are being formed, the process step jumps S10 for S11. Therefore, the trimming flag fails to be set to low, and no thread is delivered between the point "b" and the beginning "c" of the character B.

When the power supply of the pattern sewing machine 10 is turned on, the trimming flag is initially set at low.

The present invention is not limited to the embodiment described above but includes all embodiments and modifications within the scope and spirit of the invention.

What is claimed is:

1. A pattern sewing machine comprising:

(a) a stitch forming means for forming stitches on a fabric with a needle and a bobbin;

(b) a thread delivery means for delivering a predetermined amount of a thread for forming the stitches on the fabric;

(c) a thread trimming means including a movable knife and a fixed knife for trimming a needle thread and a bobbin thread between the movable knife and the fixed knife after the stitch forming means forms the stitches on the fabric;

(d) a thread trimming detection means for detecting that the thread trimming means trims the needle thread and the bobbin thread;

(e) a stitch formation detection means for detecting that the stitch forming means forms the stitches on the fabric; and (f) a delivery control means for preventing the thread delivery means from delivering the needle thread after the thread trimming detection means detects that the thread trimming means has cut the needle thread and the bobbin thread until the stitch formation detection means detects that the stitch forming means restarts the formation of stitches on the fabric.

2. A pattern sewing machine according to claim 1 wherein the thread trimming means includes:

(c1) means for cutting the needle thread and the bobbin thread between the movable knife and the fixed knife when a trimming instruction is issued.

3. A pattern sewing machine according to claim 1 wherein the thread trimming means includes:

(c2 ) means for cutting the needle thread and the bobbin thread between the movable knife and the fixed knife of the thread trimming means at the beginning of the next pattern when a needle lowers into the beginning of the next pattern to form.

4. A pattern sewing machine according to claim 1 wherein the thread trimming means includes:

(c3) means for receiving a trimming signal when a needle lowers into the end of the pattern.

5. A pattern sewing machine according to claim 1 wherein the machine further comprises:

display means for displaying a symbol of scissors on a liquid crystal display when a cut protion of a crossover thread is specified.

6. A pattern sewing machine according to claim 5 wherein the display means displays the symbol by blinking so that an operator can visually confirm the cut portion of the crossover thread.

7. A pattern sewing machine according to claim 1 wherein the machine further comprises:

means for specifying a cut portion of the crossover thread and for storing the specified cut portion in a memory.

8. A pattern sewing machine according to claim 1 wherein the machine further comprises:

means for sending a drive signal to the thread trimming means on condition that a thread trimming signal instructing trimming and a timing signal indicative of lowering of the needle bar are simultaneously received.

9. A pattern sewing machine comprising:

(a) a stitch forming unit for forming stitches on a fabric with a needle and a bobbin;

(b) a thread delivery unit for delivering a predetermined amount of a thread for forming the sitches on the fabric;

(c) a movable knife and a fixed knife for trimming a needle thread and a bobbin thread between the movable knife and the fixed knife after the stitch forming unit forms the stitches on the fabric;

(d) a thread trimming detector for detecting that the movable knife and the fixed knife trims the needle thread and the bobbin thread;

(e) a stitch formation detector for detecting that the stitch forming unit forms the stitches on the fabric; and (f) a delivery controller for preventing the thread delivery unit from delivering thread after the needle thread trimming detector detects that the thread trimming unit has cut the needle thread and the bobbin thread until the stitch formation detector detects that the stitch forming unit restarts the formation of stitches on the fabric.

10. A pattern sewing machine according to claim 9 wherein the needle bar is disconnected by disconnecting a slide from a needle bar connecting stud when a delivery controller prevents the thread delivery unit from delivering the needle thread.

11. A pattern sewing machine comprising:

(a) a timing signal generating means for generating a timing signal indicating that a needle bar is lowered;

(b) a thread delivery unit for delivering a predetermined amount of a thread for forming the stitches on the fabric insynchronism with the timing signal;

(c) a movable knife and a fixed knife for trimming the needle thread and the bobbin thread between the movable knife and the fixed knife after the stitch forming unit forms the stitches on the fabric;

(d) a thread trimming detector for detecting that the movable knife and the fixed knife trim the needle thread and the bobbin thread;

(e) a stitch formation detector for detecting that the stitch forming unit forms the stitches on the fabric;

(f) a delilvery controller for preventing the thread delivery unit from delivering thread after a trimming flag is generated until the stitch formation detector detects that the stitch forming unit restarts the formation of stitches on the fabric, the trimming flag indicating the thread trimming detector detects that the thread trimming unit has cut the needle thread and the bobbin thread.

12. A pattern sewing machine according to claim 11 wherein the delivery controller includes:

(f1) means for determining whether or not the trimming flag is in a set condition or a reset condition.

13. A pattern sewing machine according to claim 12 wherein the delivery controller includes:

(f1) means for allowing the thread delivery unit to deliver the thread after the trimming flag is in the reset condition.

14. A pattern sewing machine according to claim 11 wherein the delivery controller includes:

(f2) means for preventing the trimming flag from resetting when a needle bar is disconnected.

* * * * *